US011352832B2

(12) United States Patent
Paik et al.

(10) Patent No.: US 11,352,832 B2
(45) Date of Patent: Jun. 7, 2022

(54) AIR TIGHT DOOR

(71) Applicant: CK Solution Co., Ltd., Yongin-si (KR)

(72) Inventors: Syng Je Paik, Hwaseong-si (KR); Byung Won Jung, Suwon-si (KR)

(73) Assignee: CK Solution Co., Ltd., Yongin-si (KR)

( * ) Notice: Subject to any disclaimer, the term of this patent is extended or adjusted under 35 U.S.C. 154(b) by 0 days.

(21) Appl. No.: 16/939,896

(22) Filed: Jul. 27, 2020

(65) Prior Publication Data

US 2021/0025225 A1 Jan. 28, 2021

(30) Foreign Application Priority Data

Jul. 25, 2019 (KR) ..... KR10-2019-0090450

(51) Int. Cl.

| | |
|---|---|
| ***E06B 7/16*** | (2006.01) |
| ***E05B 65/10*** | (2006.01) |
| ***E05F 5/02*** | (2006.01) |
| ***E06B 3/36*** | (2006.01) |
| ***E06B 7/215*** | (2006.01) |
| ***E06B 7/23*** | (2006.01) |

(52) U.S. Cl.

CPC ..... *E06B 7/16* (2013.01); *E05B 65/1046* (2013.01); *E05F 5/02* (2013.01); *E06B 3/36* (2013.01); *E06B 7/215* (2013.01); *E06B 7/2305* (2013.01); *E06B 7/2309* (2013.01); *E05Y 2900/132* (2013.01)

(58) Field of Classification Search

CPC ..... E05B 65/1066; E05B 65/1053; E05B 65/1046; E06B 7/2309; E06B 7/215; E06B 7/16; E06B 3/36; E06B 7/2305

USPC ..... 49/489.1

See application file for complete search history.

(56) References Cited

U.S. PATENT DOCUMENTS

| | | | | |
|---|---|---|---|---|
| 2,935,771 A * | 5/1960 | Hatcher, Jr. | ..... | E06B 7/2309 49/493.1 |
| 3,140,517 A * | 7/1964 | Richter | ..... | E06B 7/2309 49/489.1 |
| 3,678,627 A * | 7/1972 | Dixon | ..... | E06B 7/2309 49/493.1 |

(Continued)

FOREIGN PATENT DOCUMENTS

| | | | | |
|---|---|---|---|---|
| DE | 3717753 A1 * | 12/1988 | ..... | E06B 7/215 |
| GB | 2080376 A * | 2/1982 | ..... | B60J 10/16 |

(Continued)

*Primary Examiner* — Marcus Menezes

(74) *Attorney, Agent, or Firm* — Saliwanchik, Lloyd & Eisenschenk

(57) ABSTRACT

The present disclosure relates to an air tight door including a frame having three frame members disposed, respectively, at a first lateral side, a second lateral side, and an upper side of an opening; and a longitudinal member disposed at a lower side of the opening. The door is rotatably connected to the frame member disposed at the first lateral side of the opening so as to open and/or close the opening. A first sealing disposed at each of the three frame members closely contacts the door in a closed state; and a second sealing elevatably disposed at a lower end of the door descends from the lower end of the door to closely contact the longitudinal member in the closed state. A locking device fixes a position of the door in the closed state; and an actuating device is configured to unlock the locking device.

5 Claims, 11 Drawing Sheets

(56) References Cited

U.S. PATENT DOCUMENTS 3,765,198 A * 10/1973 Horgan, Jr. ..... E05B 65/1013 70/92
4,006,562 A * 2/1977 Belanger ..... E06B 7/2312 49/380
4,157,634 A * 6/1979 Coulston ..... E06B 7/2316 49/489.1
4,658,548 A * 4/1987 Gerritsen ..... E06B 7/23 49/489.1
4,753,042 A * 6/1988 Adkins ..... E06B 7/2314 400/485
5,063,711 A * 11/1991 Huelin ..... E06B 1/18 49/504
5,095,657 A * 3/1992 Marsh ..... E06B 7/2309 49/492.1
5,095,658 A * 3/1992 Anderhalden ..... E06B 7/2309 49/479.1
5,581,951 A * 12/1996 Ryan ..... E06B 7/2309 49/489.1
5,887,392 A * 3/1999 Martin ..... E06B 3/44 52/204.5
9,828,798 B1 * 11/2017 Lahita ..... E06B 5/18
2020/0040611 A1 * 2/2020 Lehner, Jr. ..... E05B 65/0014
2020/0240179 A1 * 7/2020 Grewe ..... E05B 65/106
2020/0270935 A1 * 8/2020 Mittelstadt ..... E06B 3/5892

FOREIGN PATENT DOCUMENTS

GB 2092652 A * 8/1982 ..... E06B 7/231
JP 2562305 Y2 2/1998
KR 10-2009-0058442 A 6/2009
KR 10-2013-0128712 A 11/2013
KR 10-1450199 B1 10/2014
KR 10-1718993 B1 3/2017
KR 10-1932691 B1 12/2018

* cited by examiner

AIR TIGHT DOOR

CROSS-REFERENCE TO RELATED APPLICATION

This application claims priority to Korean Patent Application No. 10-2019-0090450, filed Jul. 25, 2019, which is hereby incorporated by reference in its entirety.

FIELD

The present disclosure relates to an air tight door, and more particularly, to an air tight door having a sealing disposed at each rim of the door so as to provide excellent sealing performance.

BACKGROUND

In general, a door is provided to open and/or close a divided indoor space, and to enable a person or object to enter into or exit from the indoor space.

Such a door is installed either in a sling form where the door is rotated and a slide form where the door is slid, to open and/or close the entrance of the door frame.

However, the door has a gap formed between itself and the door frame, and therefore, needs a separate packing to completely seal the indoor space.

For example, in cases of cooling and/or heating, heat loss has to be minimized to save the cooling and/or heating costs, and in cases where the indoor space is a smoking room, it is desirable to inhibit the cigarette smoke in the indoor space from leaking out through the gap.

To solve this, weather strips are being bonded along the edge of the doors to seal the gap between the closed doors and the door frames, but there is a problem that weather strips cannot thoroughly seal the gap.

Thus, as disclosed in Korean patent laid-open publication no. 10-2013-0128712, a door packing structure was developed where a groove is formed along the door frame, and a packing is installed in the groove to seal the gap between the door and the door frame.

However, in cases of applying such a door packing structure to a swing door, since the base end portion of the door needs to be distanced from the bottom surface, the packing structure could only be applied to both sides and to an upper side of the door, and accordingly, there is a problem that in the state where the door is closed, the distanced space between the lower end and the bottom surface of the door cannot be maintained to be air tight.

Further, in prior art packing structures, the body part and the buffer part constituting the packing are integrally formed, the body part being inserted into a groove formed in the doorframe and then fixed there. In this structure, it is not easy to insert the body part into the groove of the doorframe at a constant depth along the longitudinal direction of the packing. Therefore, there is a problem of difficulty in installation, which leads to a problem of possibility of non-uniform quality depending on the proficiency of the packing installation worker, since due to the uneven protruding length of the buffer part, some areas of the packing of the entire length may not closely contact the door.

PRIOR ART LITERATURE

Patent Literature

Patent Literature 1. Korean Laid-open Patent No. 10-2013-0128712 (Nov. 27, 2013)

SUMMARY

Therefore, a purpose of the present disclosure is to solve the aforementioned problems of prior art, that is, to provide an air tight door where a sealing is disposed at each rim of the door to provide excellent sealing performance.

Further, another purpose of the present disclosure is to provide an air tight door of which an actuating device disposed at each of a front surface and a rear surface of the door to unlock a locking device actuates in an opening direction of the door, and therefore, enables the door to be easily opened in case of fire and/or emergencies, and that has an intuitive operation method, providing convenience in using.

The aforementioned purposes are achieved by an air tight door according to the present disclosure, that includes a frame including a first longitudinal member disposed at each of both lateral sides and an upper side of an opening, and a second longitudinal member disposed at a lower side of the opening; a door that is rotatably connected to the first longitudinal member disposed at one side of the opening so as to open and/or close the opening; a first sealing that is disposed at each of the first longitudinal member of the frame, and that closely contacts the door in a state where the door has closed the opening; and a second sealing that is elevatably disposed at a lower end of the door, and that descends from the lower end of the door to closely contact an upper surface of the second longitudinal member in the state where the door has closed the opening; a locking device that fixes a position of the door in the state where the door has closed the opening; and an actuating device disposed at each of both surfaces of the door so as to unlock the locking device.

Here, it is desirable that the actuating device includes a push type lever disposed at one surface of the door, and a pull type lever disposed at another surface of the door, and that an actuating direction of the push type lever and the pull type lever is set to be the same as the opening direction of the door.

Further, it is desirable that the second longitudinal member of the frame includes an inclined surface that connects a bottom surface against which a lower part of the frame is supported to an upper surface of the second longitudinal member.

Further, it is desirable that the first longitudinal member is provided with an insertion groove where the first sealing may be seated, and the first sealing includes a fixed body that is fixed inside the insertion groove, and an elastic tube that extends from the fixed body to closely contact the door.

Further, it is desirable that the elastic tube is made in the form of a hollow circular tube, and that a center at a rear end of the elastic tube is provided with a neck that connects the fixed body and the elastic tube.

Further, it is desirable that both sides of the elastic tube are provided with a guiding bar that extends in a direction parallel with both side walls facing the insertion groove.

Further, it is desirable that the first longitudinal member is provided with a stopper that limits additional rotation of the door in a state where the door has moved to a closed position; and the insertion groove is provided on a surface of the stopper facing the door.

According to the present disclosure, an air tight door is provided, that has a sealing disposed at each rim of the door, thereby providing excellent sealing performance.

Further, there is provided an air tight door of which an actuating device disposed at each of a front surface and a rear surface of the door to unlock a locking device actuates in an opening direction of the door, and therefore, enables the door to be easily opened in case of fire and/or emergencies, and that has an intuitive operation method, providing convenience in using.

DETAILED DESCRIPTION

Figure 1:
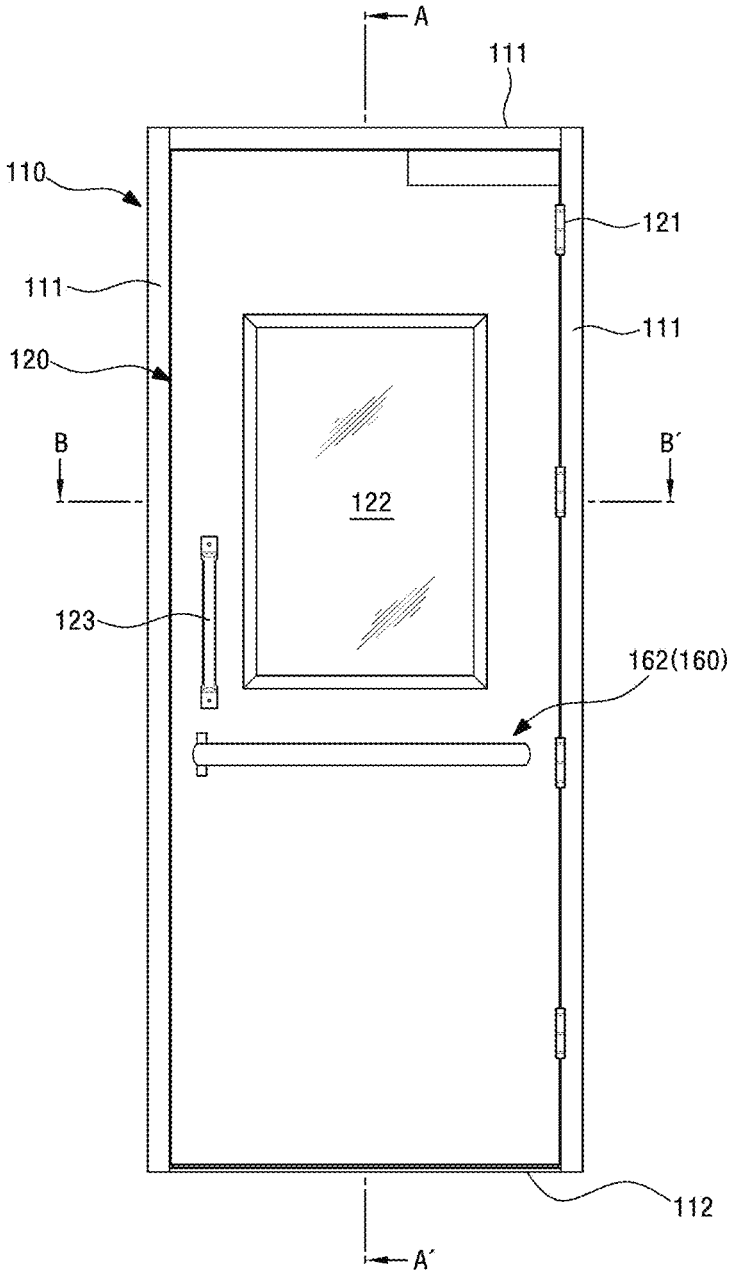
FIG. 1 is a front view of an air tight door of the present disclosure.

Prior to the description, it is to be noted that in various embodiments, components having the same configuration are typically described in the first embodiment using the same reference numerals, and in other embodiments, only the configurations different from the first embodiment will be described.

Hereinbelow, an air tight door according to the first embodiment of the present disclosure will be described in detail with reference to the drawings attached.

Figure 2:
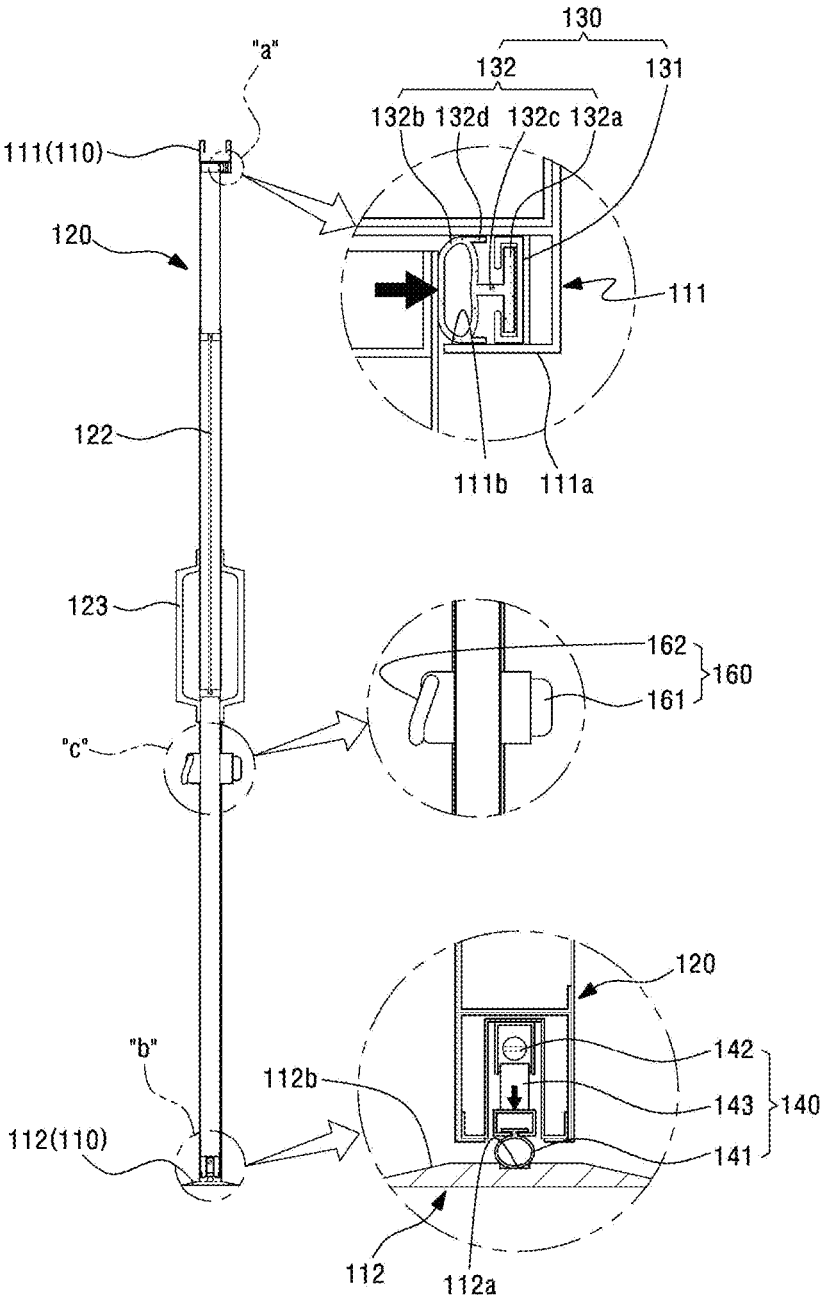
FIG. 2 is a cross-sectional view of FIG. 1 cut along line A-A'.
Figure 3:
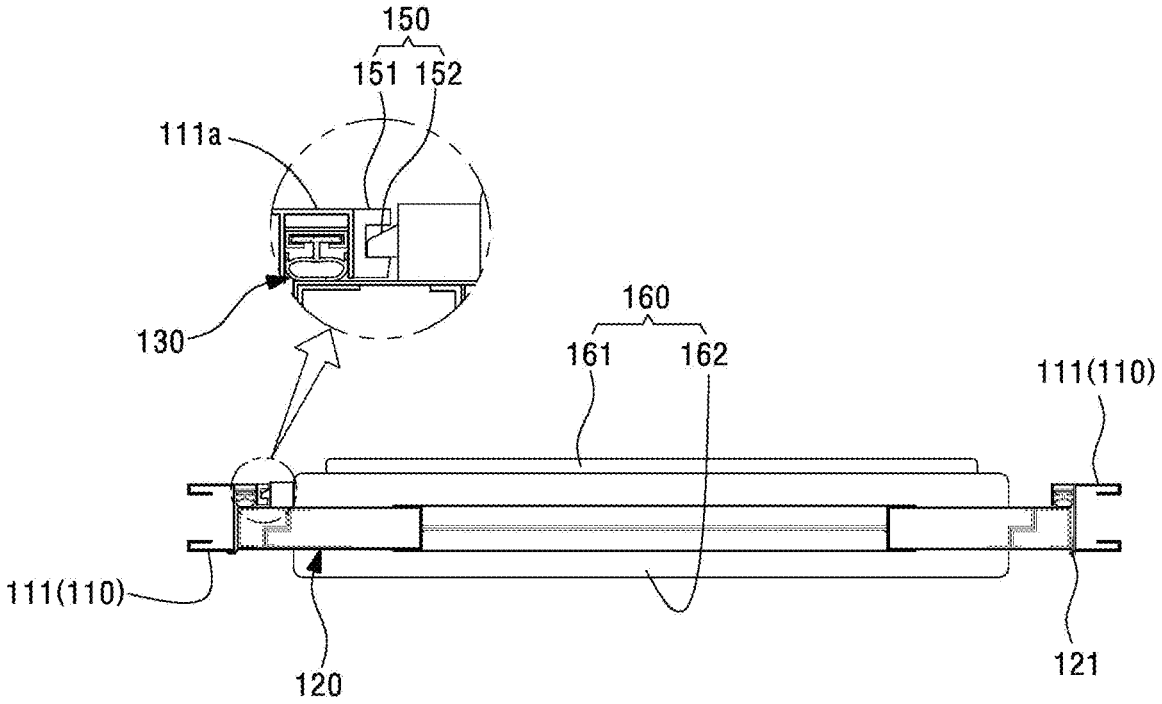
FIG. 3 is a cross-sectional view of FIG. 1 cut along line B-B'.

Of the attached drawings, FIG. 1 is a front view of the air tight door of the present disclosure, FIG. 2 is a cross-sectional view of FIG. 1 cut along line A-A', and FIG. 3 is a cross-sectional view of FIG. 1 cut along line B-B'.

The air tight door of the present disclosure as illustrated in the aforementioned drawings includes a frame 110, the door 120, a first sealing 130, a second sealing 140, a locking device 150, and an actuating device 160.

The frame 110 surrounds a rim of an opening of the frame 110, and consists of a first longitudinal member 111 disposed at each of both lateral sides and an upper side of the opening, and a second longitudinal member 112 disposed at a lower side of the opening.

The first longitudinal member 111 includes a fixation unit that may be fixed to a wall of a structure, a stopper 111*a* that protrudes from one side of a surface of the fixation unit facing the opening, towards the opening, to guide a closing position of the door 120, and an insertion groove 111*b* that is recessed from a surface of the stopper 111*a* facing the door 120.

The second longitudinal member 112 may be fixed to a bottom surface of the structure, and may include, on an upper surface thereof, a seating groove 112*a* that is recessed along a longitudinal direction and where a second sealing 140 may be seated, and on a front and rear of the second longitudinal member 112, an inclined surface 112*b* that connects the bottom surface of the structure to the upper surface of the second longitudinal member 112.

The door 120 is rotatably connected to the first longitudinal member 111 disposed in a vertical direction from one side of the frame 110 through a hinge 121 so that the opening of the frame 110 can be opened or closed depending on a rotating position of the door 120.

Further, the door 120 may be automatically rotated by a door closer in a closing direction, and the door 120 may have a reinforcing plate installed to increase the rigidness of the area where the door closer may be fixed.

Meanwhile, on the door 120, a transparent window 122 may be provided, that is finished by a transparent glass to enable one to observe inside or outside the door, and on a front surface and a rear surface of the door 120, a handle 123 may be provided to enable one to grasp and open the door 120.

The first sealing 130 is disposed inside the insertion groove 111*b* of the first longitudinal member 111, to closely contact the door 120 in a position where the door 120 has closed the opening, and the first sealing 130 includes a fixed bar 131 that is fixed inside the insertion groove 111*b*, and an elastic body 132 having one end fixed to the fixed bar 131 and another end protruding through the opening of the insertion groove 111*b*.

Specifically, the fixed bar 131 is made in an angled-pipe form having at one side a slit formed to communicate with an inside space of the fixed bar 131. Further, the elastic body 132 consists of a fixed body 132*a* that is inserted into the inside space of the fixed bar 131 through the slit of the fixed bar 131 and thus supported, an elastic tube 132*b* having a circular form disposed at the opening side of the insertion groove 111*b*, a neck 132*c* that connects the fixed body 132*a* and the elastic tube 132*b*, and a guiding bar 132*d* that extends from both sides of the elastic tube 132*b* in a parallel direction with both walls of the insertion groove 111*b*, to inhibit the elastic tube 132*b* from being constricted and stuck to the inside of the insertion groove 111*b*.

The second sealing 140 is elevatably disposed at a lower end of the door 120, and when the door 120 is closed, the second sealing 140 descends and closely contacts the second longitudinal member 11, and the second sealing 140 includes a sealing member 141 that is disposed at the lower end of the door to be moveable up and down, a push bar 142 that is disposed above the sealing member 141 and in parallel with the sealing member 141, and of which a front end protrudes through a side end of the door 120, and a connecting member 143 that is disposed between the push bar 142 and the sealing member 141, and that moves the sealing member 141 in a lower side direction when the front end of the push bar 142 is pressurized in an axial direction.

Meanwhile, in the drawings of the present embodiment, it was described as an example that the connecting member 143 is made in a link form and that the connecting member 143 is in conjunction with the push bar 142 to elevate the sealing member 141, but there is no limitation thereto, and thus, the connecting member 143 may be made in various forms for converting the left-right linear motion of the push bar 142 into an up-down linear motion of the sealing member 141.

Further, a protruding length of the push bar 142 may be adjusted by a length adjuster that may be screwed to the front end of the push bar 142, and the push bar 142 may be elastically-supported in a protruding direction by an elastic member provided at a rear end of the push bar 142. Further, it is desirable that the sealing member 141 is elastically supported in an upper side direction by a separate elastic member.

The locking device 150 consists of a strike 151 that is disposed at the frame 110 side, and a hook 152 that is disposed at the door 120 side and that interlocks with the strike 151.

The hook 152 may move in a locking direction or in an unlocking direction by the actuating device 160. In a state where the hook 152 moves in the locking direction, the hook 152 interlocks with the strike 151 and fixes the door 120 in the closed position, and in a state where the hook 152 moves in the unlocking direction, the door 120 becomes able to rotate towards the open position as the engagement with the strike 151 is unlocked.

The actuating device 160 is for moving the hook 152 of the locking device 150 in the locking direction or in the unlocking direction, and the actuating device 160 includes a push type lever 161 in the form of a panic bar that is disposed at one side surface of the door facing the inside space, and a pull type lever 162 disposed at another side surface of the door 120 facing the outside space.

The push type lever 161 is configured to move the hook 152 of the locking device 150 in the unlocking direction by a force acting in the direction of pushing the door 120, and the pull type lever 162 is configured to move the hook 152 of the locking device 150 in the unlocking direction by a force acting in the direction of pulling the door 120. That is, the actuating device 160 actuates in a push/pull method depending on the opening direction of the swing door 120, and therefore, the door can be easily opened in case of fire and emergencies, and since the actuating method is intuitive, it is also convenient to use.

Meanwhile, the connection structure of the push type lever 16 and the hook 152 and the connection type of the pull type lever 162 and the hook 152 may be made in various forms. For example, between the push type lever 161 and the hook 152, there may be disposed a power transmission device that may convert a front-rear direction linear motion into a left-right direction linear motion of the hook 152, and between the pull type lever 162 and the hook 152, there may be disposed a power transmission device that may convert a front-rear direction rotating motion of the pull type lever 162 into a linear motion of the hook 152. Such a power transmission device is for transmitting the kinetic energy being applied through the actuating device 160 to the hook 152 of the locking device 150, and the power transmission device 160 may be made in various forms such as a cam, link, gear and the like.

Hereinbelow, operation of a first embodiment of the air tight door described above will be described in detail.

Figure 4:
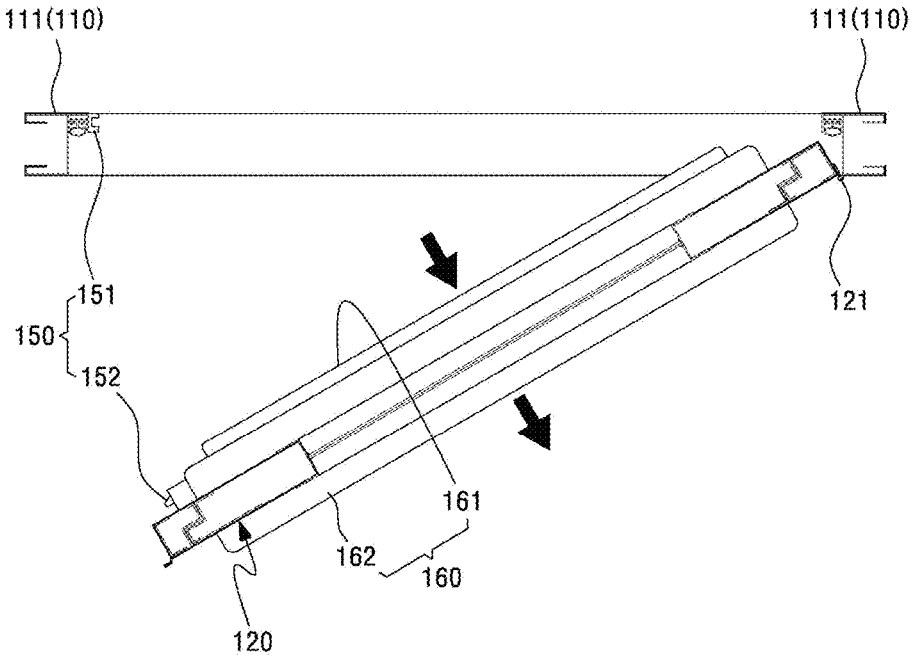
FIG. 4 is an action view illustrating a state where the air tight door of the present disclosure is open.
Figure 5A:
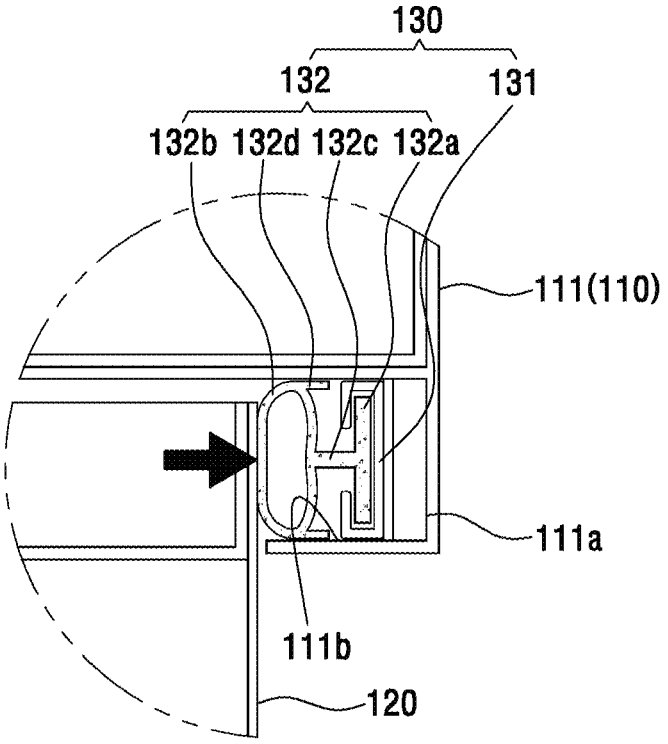
FIGS. 5A and 5B are action views of "a" portion of FIG. 2, FIGS. 6A, 6B, 7A and 7B are action view of "b" portion of FIG. 2, and FIGS. 8A, 8B, 9A and 9B are action views of "c" portion of FIG. 2.
Figure 5B:
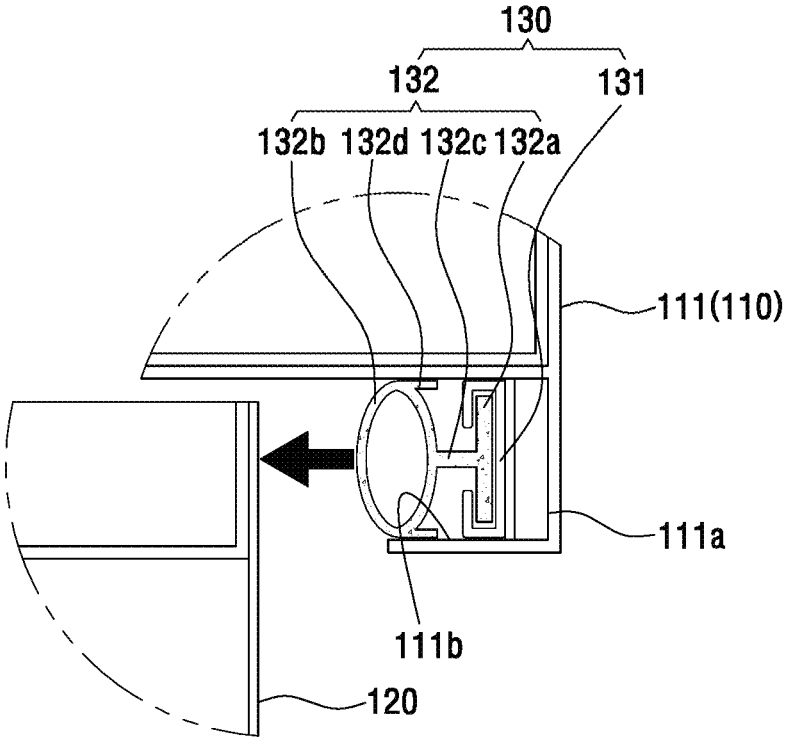

Of the attached drawings, FIG. 4 is an action view illustrating a state where the air tight door of the present disclosure is open, FIGS. 5A and 5B are action views of "a" part of FIG. 2, FIGS. 6A, 6B, 7A and 7B are action views of "b" part of FIG. 2, and FIGS. 8A, 8B, 9A and 9B are action views of "c" part of FIG. 2.

Specifically, FIGS. 2 and 3 illustrate a state where the door 120 closed the opening of the frame 110, and FIG. 4 illustrates a state where the door 120 opened the opening of the frame 110.

As illustrated in FIGS. 3 and 4, the door 120 is rotatably connected to the first longitudinal member 111 disposed at one side of the opening of the frame 110 through the hinge 121, and depending on a rotating position, the opening of the frame 110 may be opened or closed.

Here, on the first longitudinal member 111 disposed at each of both lateral sides and the upper side of the opening of the frame 110, there is disposed the first sealing 130 that closely contacts the door 120 in a state where the door is closed, and on a lower end of the door 120, there is disposed the second sealing 140 that closely contacts the second longitudinal member 112 disposed at a lower side of the opening of the frame in a state where the door 120 is closed, and therefore, it is possible to secure air-tightness of the gap between the door 120 and the frame 110 in the state where the door 120 closed the opening.

As illustrated in FIGS. 5A and 5B, in a state where the door 120 has closed the opening of the frame 110, as the first sealing 130 disposed at the first longitudinal member 111 closely contacts the door 120, a contact surface of the first longitudinal member 111 and the door 120 may be maintained in an air tight state.

That is, as in FIG. 5A, the stopper 111*a* of the first longitudinal member 111 that is formed to protrude from one side of the surface facing the opening, towards the opening, guides the position of the door 120 in a state where the door 120 has completely closed the opening, thereby limiting additional rotation of the door 120.

Here, in the insertion groove 111*b* formed in the surface of the stopper 111*a* facing the door 120, the first sealing 130 is disposed, and as the elastic body 132 of such a first sealing 130 closely contacts the door 120, air-tightness can be secured. That is, since the first sealing 130 provided on each first longitudinal member 111 closely contacts the door 120 in a state where the door 120 has closed the opening, when the door 120 is closed, both sides of the door 120 and the upper gap can be maintained in an air tight state.

Specifically, the fixed body 132*a* of the elastic body 132 provided at the rear end of the elastic body 132 is inserted inside the fixed bar 131 through the slit formed in the fixed bar 131 and supported, and the fixed bar 131 is inserted into the insertion groove 111*b* in a state where the fixed bar 131 is supporting the elastic body 132, and then the fixed bar 131 is firmly fixed inside the insertion groove 111*b* through adhesive or a separate fixing means. When inserting the elastic body inside the insertion groove, the fixed bar 131 inhibits the elastic body 132 from directly contacting the insertion groove 111*b* and therefore, it is not only possible to easily install the elastic body 132 made of soft material such as rubber inside the insertion groove 111*b*, but it is also possible to inhibit the elastic body 132 from arbitrarily deviating inside the insertion groove 132.

Further, the elastic tube 132*b* provided at the front end of the elastic body 132 is made in the form of a hollow circular cross-section, and since a center of the rear end of the elastic tube 132*b* is connected to the fixed body 132*a* by the neck 132*c*, the amount of elastic deformation in the compression direction of the elastic tube 132*b* can be increased. Further, since the guiding bar 132*d* provided at both sides of the elastic tube 132*b* slides along the inner walls at both sides of the insertion groove 111*b*, in the process where the elastic tube 132*b* makes an elastic deformation, elastic deformation is made only in the direction where the compression force acts, and accordingly, the neck 132*c* is inhibited from bending, thus inhibiting the elastic tube 132*b* from being compressed and attached to the inside of the insertion groove 111*b*.

Meanwhile, as in FIG. 5B, when the door 120 rotates to be opened and is distanced from the elastic body 132 of the first sealing 130, the elastic tube 132*b* of the elastic body 132 protrudes through the opening of the insertion groove 111*b* as the elastic tube 132*b* is elastically restored. Here, when the elastic tube 132*b* is elastically restored, the movement is guided by the guiding bar 132*d* provided at both sides of the elastic tube 132*b*, and therefore, the elastic tube 132*b* can be inhibited from being compressed and attached to the inside of the insertion groove 111*b*.

Figure 6A:
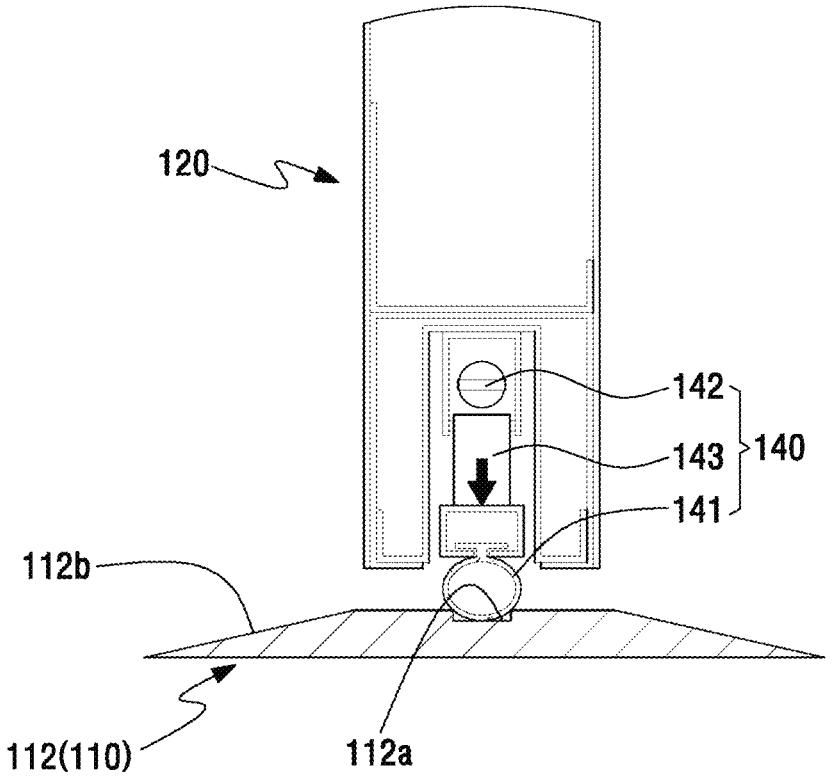
Figure 6B:
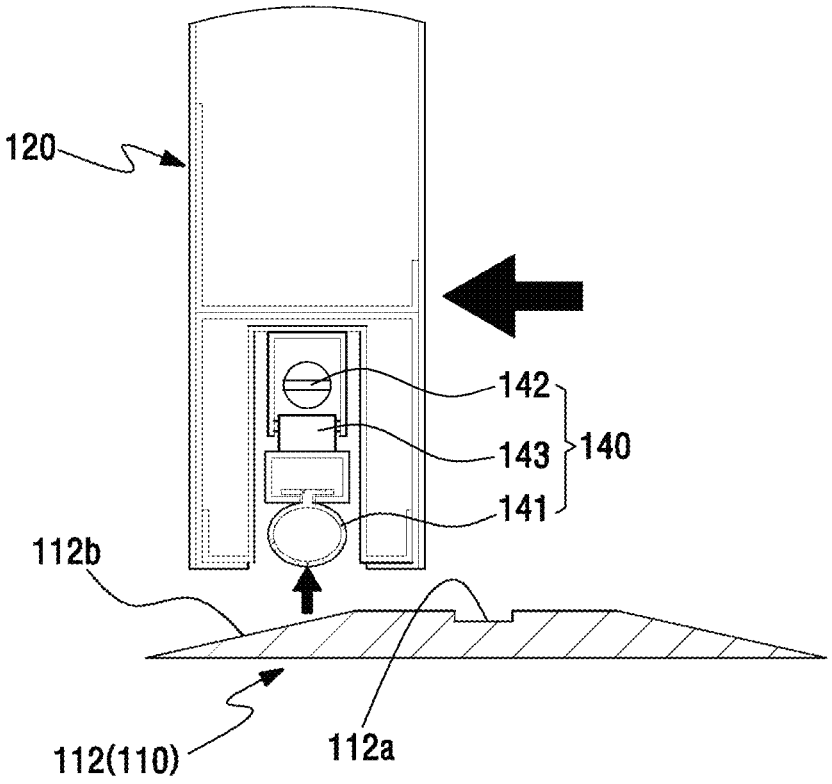

As illustrated in FIGS. 6A, 6B, and 7, the second sealing 140 disposed at the lower end of the door 120 selectively contacts with the second longitudinal member 112 disposed at the lower end of the opening of the frame 110 as the second sealing 140 elevates from the lower end of the door 120 depending on the rotating position of the door 120.

That is, as in FIG. 6A, the sealing member 141 of the second sealing 140 disposed at the lower end of the door 120 descends to closely contact the upper surface of the second longitudinal member 112 in a state where the door 120 has closed the opening of the frame 110. Here, on the upper surface of the second longitudinal member 112, there is provided the seating groove 112*a* where the sealing member of the second sealing 140 can be seated, and therefore, air-tightness of the second sealing can be further improved.

Further, as in FIG. 6B, when the door 120 is rotated to be opened, the second sealing 140 disposed at the lower end of the door 120 elevates to be distanced from the upper surface of the second longitudinal member 112, and therefore, in the rotating process of the door 120, the second sealing 140 can be inhibited from unnecessarily contacting the second longitudinal member 112 or the bottom surface that supports the lower portion of the frame 110.

Meanwhile, on the second longitudinal member 112, there is provided an inclined surface 112*b* that connects the bottom surface of the structure and the upper surface of the second longitudinal member 112. Therefore, even when the second sealing 140 malfunctions and the door 120 rotates to be closed in a state where the sealing member 141 has descended, the sealing member 141 may elevate along the inclined surface 112*b* and be seated on the upper surface of the second longitudinal member 112.

Figure 7A:
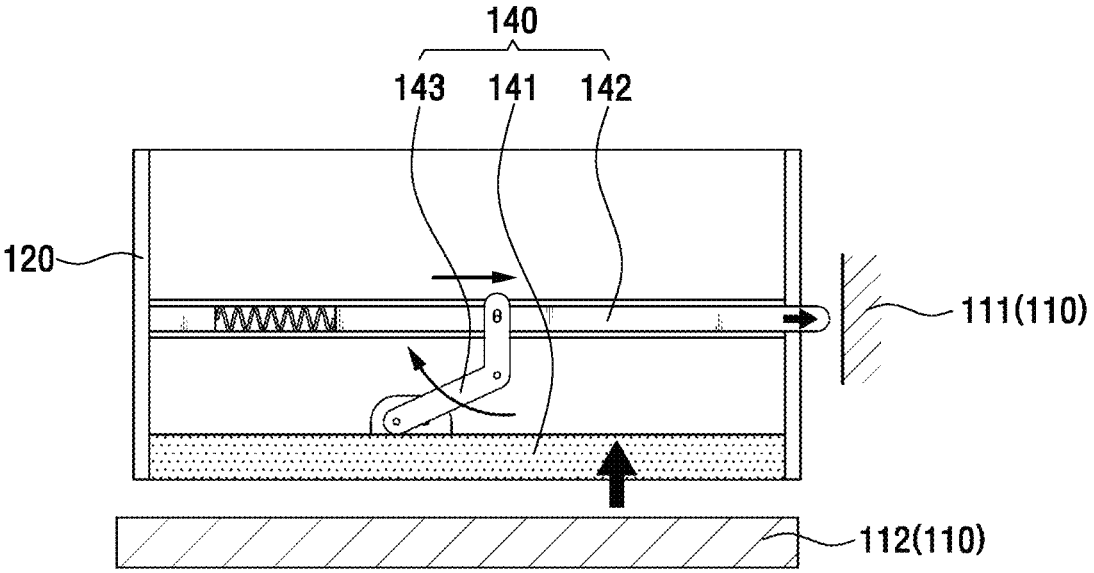

Looking at the elevating process of the second sealing 140 as described above, first of all, when the side end of the door 120 is distanced from the first longitudinal member 111 of the frame 110 by the opening of the door 120 as in FIG. 7A, the front end of the push bar 142 located at the side end of the door 120 will be moved towards the protruding direction by the elastic force of the elastic member, and in this process, the sealing member 141 connected to the push bar 142 through the connecting member 143 will elevate.

Figure 7B:
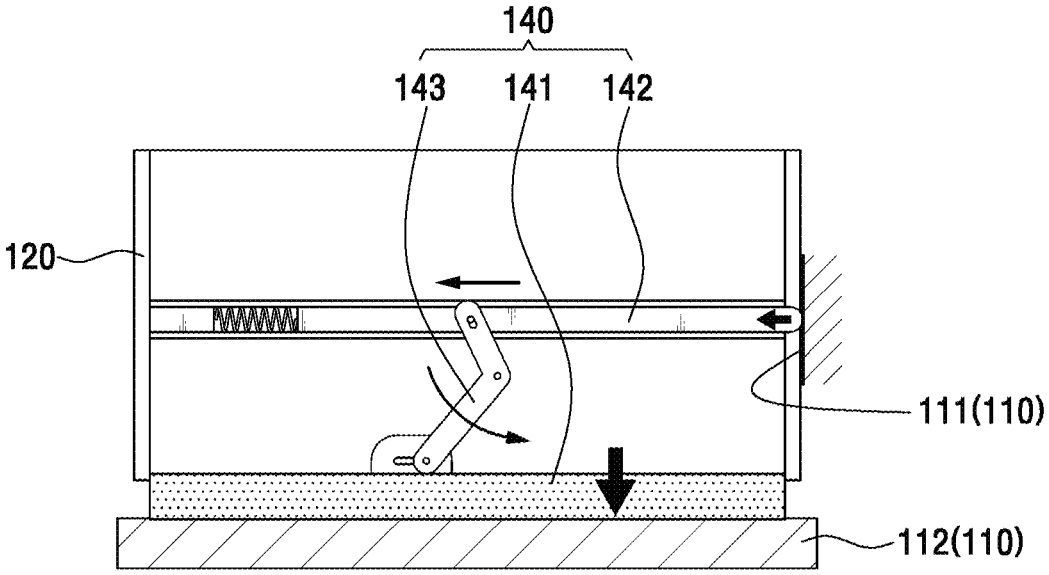

Next, when the side end of the door 120 is disposed closely adjacent to the first longitudinal member 111 of the frame 110 by the closing of the door 120 as in FIG. 7B, the front end of the push bar 142 located at the side end of the door 120 will be pressurized by the first longitudinal member 111 and to move in the insertion direction, and accordingly, the sealing member 141 connected to the push bar 142 through the connecting member 143 will descend and closely contact the upper surface of the second longitudinal member 112.

That is, when the door 120 opens, the sealing member 141 of the second sealing 140 will elevate to be distanced from the second longitudinal member 112, and therefore, the sealing member 141 will be inhibited from making friction with the second longitudinal member 112 in the rotating process of the door, and when the door 120 is closed, the sealing member 141 of the second sealing 140 will descend to closely contact the upper surface of the second longitudinal member 112, thereby maintaining the gap of the lower part of the door 120 in an air tight state.

Figure 8A:
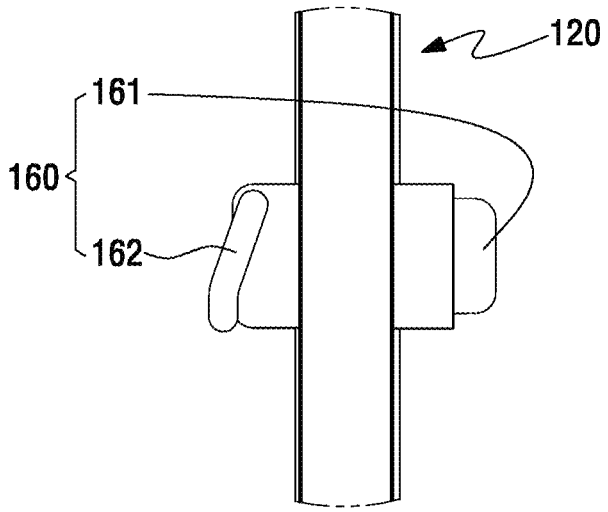
Figure 8B:
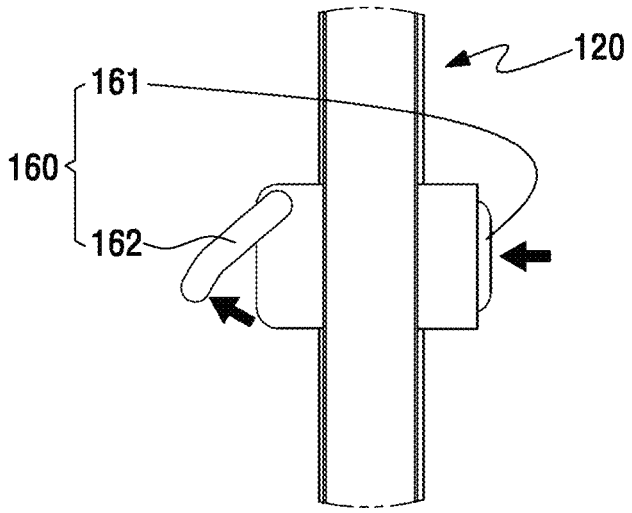

Further, in the present embodiment, the door 120 is constituted as a swing door 120 that can be opened as it rotates from the indoor side towards the outdoor side, and as illustrated in FIGS. 8A, 8B, and 9, the push type lever 161 of the actuating device 160 is disposed at one side surface of the door 120 facing the indoor space, and the pull type lever 162 is disposed at another side surface of the door 120 facing the outdoor space.

Figure 9A:
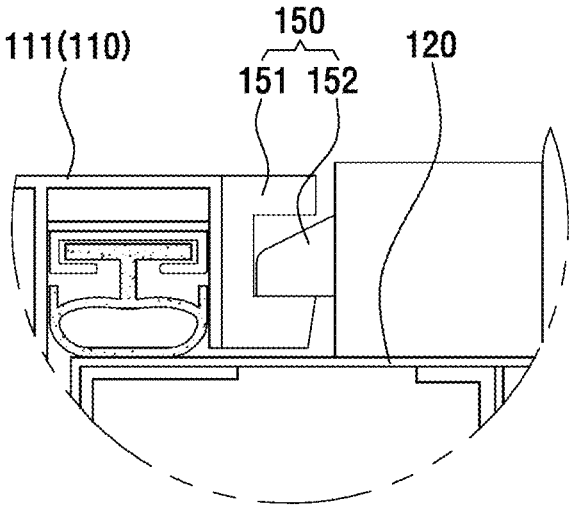
Figure 9B:
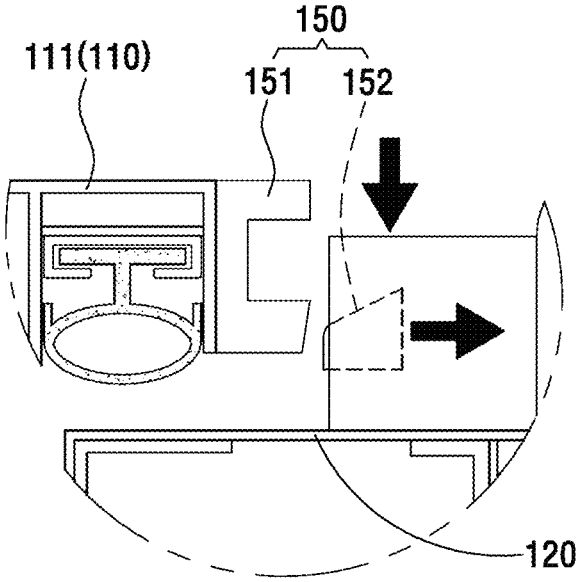

Specifically, FIG. 8A and FIG. 9A illustrate the closed state of the door 120, and in a state where external force is not applied to the actuating device 160 as in FIG. 8A, the push type lever 161 of the actuating device 160 is maintained in a protruding state, and the pull type lever 162 is maintained in a rotated state to the locking position, in which case, as in FIG. 9A, the hook 152 of the locking device 150 installed at the door 120 interlocks with the strike 151 installed on the frame 110, thereby inhibiting the door 120 from arbitrarily rotating towards the opening side.

Meanwhile, when the push type lever 161 disposed on the surface facing the indoor space of the door 120 is pressurized in the opening direction of the door, or the pull type lever 162 disposed on the surface facing the outdoor space of the door 120 is pulled towards the opening direction of the door 120 as in FIG. 8B, the hook 152 of the locking device 150 will cooperate with the operation of the push type lever 161 or the pull type lever 162 to move towards the unlocking direction, and thereby releasing the interlocking with the strike 151. Here, as the actuating direction of the push type lever 161 and the pull type lever 162 is set to be the same as the opening direction of the door 120, the door 120 will be opened by the force actuating the actuating device 160.

That is, since the actuating direction of the push type lever 161 and the pull type lever 162 of the actuating device 160 is set to be the same as the opening direction of the door 120, not only is the operation method intuitive, but the opening of the door 120 will be made by the operation of the user manipulating the actuating device 160, thereby providing convenience in use and easy opening of the door in case of fire and/or emergencies.

The scope of rights of the present invention is not limited to the above-described embodiments, but may be implemented in various forms of embodiments within the scope of the appended claims. Any person having ordinary skill in the art to which the present invention pertains without departing from the gist of the present invention as claimed in the claims is deemed to be within the scope of the claims of the present invention to a wide range that can be modified.

REFERENCE NUMERALS

110: FRAME, 111: FIRST LONGITUDINAL MEMBER, 111A: STOPPER, 111B: INSERTION GROOVE, 112: SECOND LONGITUDINAL MEMBER, 112A: SEATING GROOVE, 112B: INCLINED SURFACE, 120: DOOR, 121: HINGE, 122: TRANSPARENT WINDOW, 123: HANDLE, 130: FIRST SEALING, 131: FIXED BAR, 132: ELASTIC BODY, 132A: FIXED BODY, 132B: ELASTIC TUBE, 132C: NECK, 132D: GUIDING BAR, 143: CONNECTING MEMBER, 150: LOCKING DEVICE 151: STRIKE, 152: HOOK, 160: ACTUATING DEVICE, 161: PUSH TYPE LEVER, 162: PULL TYPE LEVER

The invention claimed is:

1. An air tight door comprising:

a frame including a first longitudinal member disposed at each of both lateral sides and an upper side of an opening, and a second longitudinal member disposed at a lower side of the opening;

a door that is rotatably connected to the first longitudinal member disposed at one side of the opening so as to open and/or close the opening;

a first sealing that is disposed on the first longitudinal member along both lateral sides and the upper side of the opening, and that closely contacts the door in a state where the door has closed the opening; and a second sealing that is elevatably disposed at a lower end of the door, and that descends from the lower end of the door to closely contact an upper surface of the second longitudinal member in the state where the door has closed the opening;

a locking device that fixes a position of the door in the state where the door has closed the opening; and an actuating device disposed at each of a front surface and a rear surface of the door so as to unlock the locking device, wherein the first longitudinal member is provided with an insertion groove where the first sealing is seated, wherein the first sealing includes a fixed body that is fixed inside the insertion groove, and an elastic tube that is located inside the insertion groove and extends from the fixed body to closely contact the door in the state where the door has closed the opening, and wherein first and second sides of the elastic tube are each provided with a guiding bar that extends in a direction parallel with first and second side walls facing the insertion groove so as to inhibit the elastic tube from being constricted and stuck to the inside of the insertion groove.

2. The air tight door according to claim 1, wherein the actuating device includes a push-type lever disposed at one surface of the door, and a pull-type lever disposed at another surface of the door, and an actuating direction of the push-type lever and the pull-type lever is set to be the same as an opening direction of the door.

3. The air tight door according to claim 1, wherein the second longitudinal member of the frame includes an inclined surface that connects a bottom surface against which a lower part of the frame is supported to an upper surface of the second longitudinal member.

4. The air tight door according to claim 1, wherein the elastic tube is made in the form of a hollow circular tube, and a center at a rear end of the elastic tube is provided with a neck that connects the fixed body and the elastic tube.

5. The air tight door according to claim 1, wherein the first longitudinal member is provided with a stopper that limits additional rotation of the door in the state where the door has closed the opening; and the insertion groove is provided on a surface of the stopper facing the door.

* * * * *